US008087279B2

(12) United States Patent
Nakajima et al.

(10) Patent No.: US 8,087,279 B2
(45) Date of Patent: Jan. 3, 2012

(54) METHOD AND APPARATUS FOR MANUFACTURING A LEGGED ANNULAR MEMBER

(75) Inventors: Masaki Nakajima, Anjo (JP); Takehiko Adachi, Anjo (JP); Ariyoshi Terao, Anjo (JP)

(73) Assignee: Aisin AW Co., Ltd., Anjo (JP)

( * ) Notice: Subject to any disclaimer, the term of this patent is extended or adjusted under 35 U.S.C. 154(b) by 905 days.

(21) Appl. No.: 12/053,708

(22) Filed: Mar. 24, 2008

(65) Prior Publication Data

US 2008/0250839 A1 Oct. 16, 2008

(30) Foreign Application Priority Data

Apr. 13, 2007 (JP) ..... 2007-106411

(51) Int. Cl.
*B21J 13/00* (2006.01)
*B21D 22/00* (2006.01)
*B21D 28/00* (2006.01)

(52) U.S. Cl. ..... 72/354.6; 72/355.4; 72/356; 72/352; 72/340

(58) Field of Classification Search ..... 72/355.2, 72/355.4, 355.6, 352, 354.6, 354.8, 358–359, 72/332, 340–341, 356
See application file for complete search history.

(56) References Cited

U.S. PATENT DOCUMENTS

| | | | | |
|---|---|---|---|---|
| 3,688,549 | A * | 9/1972 | Toshimi et al. | 72/334 |
| 4,440,282 | A * | 4/1984 | Ishimaru et al. | 192/70.2 |
| 4,798,077 | A * | 1/1989 | Douglas | 72/354.8 |
| 5,575,171 | A * | 11/1996 | Sawai et al. | 72/352 |
| 7,832,247 | B2 * | 11/2010 | Cho et al. | 72/356 |
| 2007/0051156 | A1 | 3/2007 | Adachi | |

FOREIGN PATENT DOCUMENTS

| | | | |
|---|---|---|---|
| JP | 4-11168 | A | 10/1993 |
| JP | 10-296376 | A | 11/1998 |
| JP | 11-77179 | A | 3/1999 |
| JP | 2001105085 | A | 4/2001 |
| JP | 2005-11155 | A | 4/2005 |
| KR | 2007011647 | A * | 12/2007 |
| WO | 2007/026756 | A1 | 8/2007 |

* cited by examiner

*Primary Examiner* — Dana Ross
*Assistant Examiner* — Mohammad I Yusuf
(74) *Attorney, Agent, or Firm* — Sughrue Mion, PLLC

(57) ABSTRACT

A method and apparatus for manufacturing a legged annular member. In one aspect, a work member is formed from a ring-like raw material, and has an annular part and an outer wall part, which is formed from a leg part and a connecting part. The connecting part is removed from the work member to form an intermediate legged annular member having an annular part and a leg part. An inner diameter of the leg part of the intermediate legged annular member is expanded while a burr is removed to form a carrier, which serves as a legged annular member. Therefore, the number of manufacturing processes until completion of the carrier can be reduced, compared to performing separate processes to expand the diameter of the leg part and remove the burr. Thus, it is possible to shorten the period of time needed for completion of the carrier.

9 Claims, 7 Drawing Sheets

METHOD AND APPARATUS FOR MANUFACTURING A LEGGED ANNULAR MEMBER

PRIORITY CLAIM

This application claims priority to Japanese Patent Application No. 2007-106411, filed on Apr. 13, 2007, and is incorporated herein by reference in its entirety.

BACKGROUND OF THE INVENTION

1. Field of the Invention

The present invention relates to a method and apparatus for manufacturing a legged annular member. More specifically, the present invention relates to a manufacturing method and manufacturing equipment for a legged annular member having a ring-like annular part and at least one leg formed on an outer peripheral side of the annular part generally perpendicular to the annular part.

2. Description of the Related Art

Japanese Patent Application Publication No. JP-A-2001-105085, for example, proposes a conventional method for manufacturing this type of legged annular member. The proposed manufacturing method includes a preform forming process and a trimming process. In the preform forming process, a preform of a member with legs is formed by executing back side extruding formation of a disc-shaped blank (raw material) to form a bottom part, a plurality of leg parts with differing widths (thicknesses) along an outer peripheral surface of a side surface side of the bottom part, and a film part extending between the respective leg parts. In the trimming process, a center portion of the bottom part and the film part of the preform formed in the preform forming process is trimmed.

However, burrs sometimes form on the leg parts when the film part is trimmed in the trimming process according to the above-described manufacturing method for a legged annular member. Such burrs in the past were removed by hand, and a relatively long period of time was needed for completion of the legged annular member. Also, when the film part is trimmed in the trimming process, the leg parts sometimes fall slightly inward and necessitate a process to expand an inner diameter of the leg parts, which is separate from the process for removing burrs from the leg parts.

SUMMARY OF THE INVENTION

It is an object of a method and apparatus for manufacturing a legged annular member according to the present invention to reduce a number of manufacturing processes until completion of the legged annular member. It is another object of the method and apparatus for manufacturing a legged annular member according to the present invention to shorten a time required until completion of the legged annular member.

The method and apparatus for manufacturing a legged annular member according to the present invention employs the following for at least partially achieving the above objects.

According to the present invention, the method of manufacturing a legged annular member, which has a ring-like annular part and at least one leg formed on an outer peripheral side of the annular part generally perpendicular to the annular part, is characterized by including the steps of:

(a) forming a work member from a raw material with a predetermined shape, with the work member including the annular part and a skirt-like outer wall part that has a leg part structuring the leg and a connecting part connected with the leg part;

(b) forming an intermediate legged annular member by removing the connecting part from the formed work member; and (c) forming the legged annular member by expanding an inner diameter of the leg part while performing burr removal on a joining region of the leg part with the connecting part, with respect to the formed intermediate legged annular member.

In the manufacturing method for an annular member according to the present invention, the work member is formed from a raw material with a predetermined shape, with the work member having a ring-like annular part, a leg part structuring at least one leg on an outer peripheral side of the annular part generally perpendicular to the annular part, and a skirt-like outer wall part formed from a connecting part connected with the leg part. An intermediate legged annular member is then formed by removing the connecting part from the formed work member. The legged annular member is subsequently formed by expanding an inner diameter of the leg part while performing burr removal on a joining region of the leg part with the connecting part, with respect to the formed intermediate legged annular member. Accordingly, processing to expand the inner diameter of the leg part and processing to remove the burr on the joining region are performed in series. Therefore, the number of manufacturing processes until completion of the legged annular member can be reduced, compared to performing these processes separately. Thus, it is possible to shorten the period of time needed for completion of the legged annular member. Here, "a raw material with a predetermined shape" may be a ring-like raw material or the like.

In the manufacturing method for a legged annular member according to the present invention, the step (c) may be a process where burr removal on the joining region is performed by a force applied on the leg part from a side based on the annular part toward a tip end direction thereof Alternatively, the step (c) may be a process where burr removal on the joining region at generally the tip end of the leg part is performed while an outer diameter of the tip end of the leg part is expanded wider than an outer diameter of the base on the annular part.

In the manufacturing method for an annular member according to the present invention, the legged annular member may be a carrier in a planetary gear mechanism.

According to the present invention, the manufacturing equipment for a legged annular member, which has a ring-like annular part and at least one leg formed on an outer peripheral side of the annular part generally perpendicular to the annular part, includes:

a support mechanism capable of supporting at a general center of an end portion thereof an intermediate legged annular member having the annular part and a leg part that structures the leg with a burr on at least one portion thereof;

a hollow member that is disposed on an outer peripheral side of the support mechanism generally coaxial with the support mechanism, and formed such that an end portion on an inner peripheral side is circular-shaped with a diameter larger than an outer diameter of the annular part; and a diameter-expanding movement mechanism that is disposed facing the end portion of the support mechanism, and which, in a state where the annular part and the inner peripheral side of the leg part are in contact while the intermediate legged annular member is supported by the support mechanism, moves the intermediate legged annular member and the support mechanism to the support mechanism side while at least a portion of the outer diameter of the leg part is expanded larger than an inner diameter of the end portion on the inner peripheral side of the hollow member.

In the manufacturing equipment for a legged annular member according to the present invention, the intermediate legged annular member having the annular part and the leg part that structures the leg with a burr on at least one portion thereof is supported by the support mechanism at the general center of an end portion thereof In such a state, the diameter-expanding movement mechanism is moved so as to contact the annular part of the intermediate legged annular member and the inner peripheral side of the leg part, and the intermediate legged annular member and the support mechanism are moved toward the support mechanism side, while at least a portion of the outer diameter of the leg part is expanded larger than the inner diameter of the end portion on the inner peripheral side of the hollow member.

Once the intermediate legged annular member is moved toward the support mechanism side in such a manner, a portion of the leg part is contacted by the end portion of the hollow member, whose end portion on the inner peripheral side is formed in the shape of a circle with a diameter larger than the outer diameter of the annular part. Further movement towards the support mechanism side results in burr removal by the end portion of the hollow member. Accordingly, processing to expand the inner diameter of the leg part and processing to remove the burr on the joining region are performed in series.

Therefore, the number of manufacturing processes until completion of the legged annular member can be reduced, compared to performing these processes separately. Thus, it is possible to shorten the period of time needed for completion of the legged annular member.

Moreover, since burr removal is performed while expanding the outer diameter of the leg part larger than the outer diameter of the annular part, it is possible to suppress significant scraping of a portion without a burr. Here, the support mechanism may be formed such that when a force is applied to the intermediate legged annular member by the diameter-expanding movement mechanism in a state where the intermediate legged annular member is supported, a load required for moving the intermediate legged annular member is greater than a load required for expanding the inner diameter of the leg part.

In the manufacturing equipment for a legged annular member according to the present invention, the support mechanism may be disposed such that an end portion thereof projects farther than the end portion of the hollow member, and have a first air discharging portion capable of discharging air from an outside peripheral surface in the direction of the end portion of the hollow member. The diameter-expanding movement mechanism may have a second air discharging portion capable of discharging air from an end portion thereof toward the direction of the end portion of the support mechanism. In the former case, air is discharged from the outer peripheral surface of the support mechanism in the direction of the end portion of a discharging portion of the hollow member, in a state where the end portion of the support mechanism projects farther than the end portion of the hollow member. Thus, it is possible to ensure that burrs or the like cut away from the intermediate legged annular member are not deposited on the end portion of the hollow member. In the latter case, air is discharged from the end portion of the diameter-expanding movement mechanism in the direction of the end portion of the support mechanism, i.e., in the direction of the surface of the intermediate legged annular member, whereby dirt or the like can be removed from the surface of the intermediate legged annular member.

In the manufacturing equipment for a legged annular member according to the present invention, the hollow member may be formed such that at least a portion of the end portion on the inner peripheral side is generally at a right angle or an acute angle with respect to the outer peripheral side. Thus, burr removal on the leg part can be more easily performed. The hollow member may also be formed such that a portion of the end portion on the inner peripheral side has a chamfered shape. In the latter case, if the intermediate legged annular member is supported by the support mechanism such that the end portion at the general center in the circumferential direction of the leg part is set at a position corresponding to the chamfered portion of the hollow member, then it is possible to suppress scraping of the end portion at the general center in the circumferential direction of the leg part.

In the manufacturing equipment for a legged annular member according to the present invention, a fixed base with a hole for fixing the hollow member may be provided, wherein the hollow member may have a long hole that is formed in a direction generally vertical from a surface contacting a support base with a shape longer in a circumferential direction than a radial direction, and be fixed to the fixed base by a fixing member that fits with the long hole and a hole in the fixed base. Thus, rotating the hollow member in the circumferential direction can change the position in contact with the intermediate legged annular member when performing burr removal.

Alternatively, the legged annular member may be a carrier in a planetary gear mechanism.

DETAILED DESCRIPTION OF THE PREFERRED EMBODIMENT

A best mode for carrying out the present invention will be explained below using an embodiment.

Figure 1:
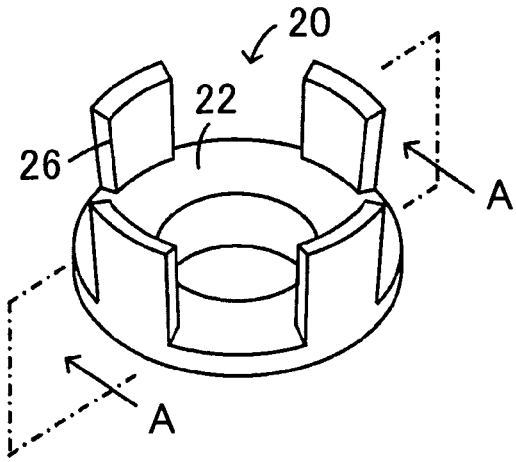
FIG. 1 is a top front perspective drawing showing an outer appearance of a carrier 20.
Figure 2:
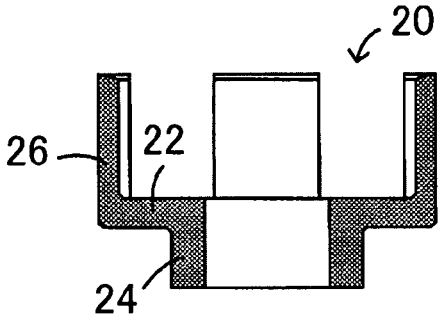
FIG. 2 is a cross-sectional view as seen from a section A-A of the carrier 20 in FIG. 1.

FIG. 1 is an top front perspective view drawing showing an outer appearance of a carrier 20, which is manufactured according to a manufacturing method for a legged annular member as an embodiment of the present invention. FIG. 2 is a cross-sectional view as seen from a section A-A of the carrier 20 in FIG. 1. The carrier 20 manufactured based on the manufacturing method of the embodiment includes, as shown in FIGS. 1 and 2, a ring-like annular part 22, a boss part 24 formed along an inner periphery of the annular part as a hollow shaft, and a leg part 26 structured with four legs that are on a side of the annular part 22 that is opposite the boss part 24 and formed on an outer peripheral side of the annular part 22 generally perpendicular to the annular part 22.

Figure 3:
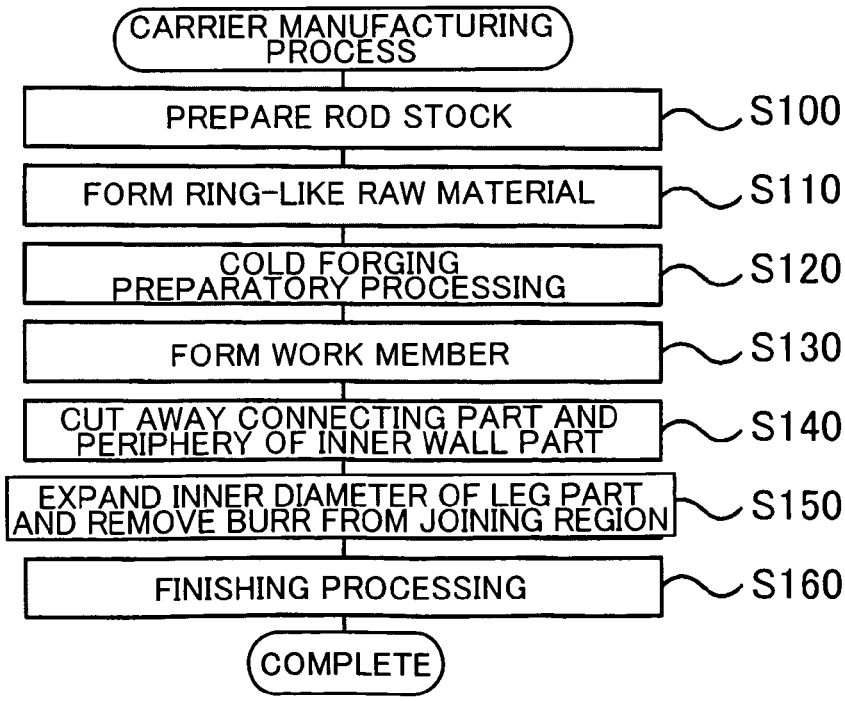
FIG. 3 is a process chart showing processes for manufacturing the carrier 20.
Figure 4:
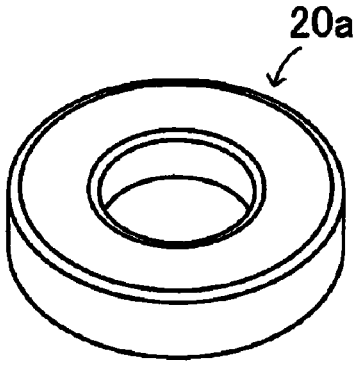
FIG. 4 is a top front perspective drawing showing an outer appearance of a ring-like raw material 20*a;*

The carrier 20 of the embodiment is manufactured as follows. FIG. 3 is a process chart showing processes for manufacturing the carrier 20 of the embodiment. Manufacturing of the carrier 20 first involves preparing rod stock from a material (e.g. a low-carbon steel, low-carbon steel alloy, aluminum, aluminum alloy, copper, copper alloy, or the like) capable of undergoing cold forging (process S100). After hot forging, warm forging, or cold forging of the prepared rod stock, a ring-like raw material 20*a* having a hole at a center thereof is formed (process S110). An example of the ring-like raw material 20*a* is shown in FIG. 4.

Preparatory processing is then performed (process S120) in order to execute process S130 and subsequent processes. Such preparatory processing may be, for example, softening of the ring-like raw material 20*a*, and shot blasting to remove scales from the surface of the ring-like raw material 20*a*, as well as C-surface cutting (chamfering), width cutting, and phosphate coating in order to form the shape of the ring-like raw material 20*a*. Note that phosphate coating is processing that forms a chemical film (such as a phosphate film or the like) on the surface of the ring-like raw material 20*a* and that coats using a metallic soap on the surface of the formed chemical film, in order to minimize friction resistance between processing equipment and the raw material 20*a* when performing press work to be described later.

Figure 5:
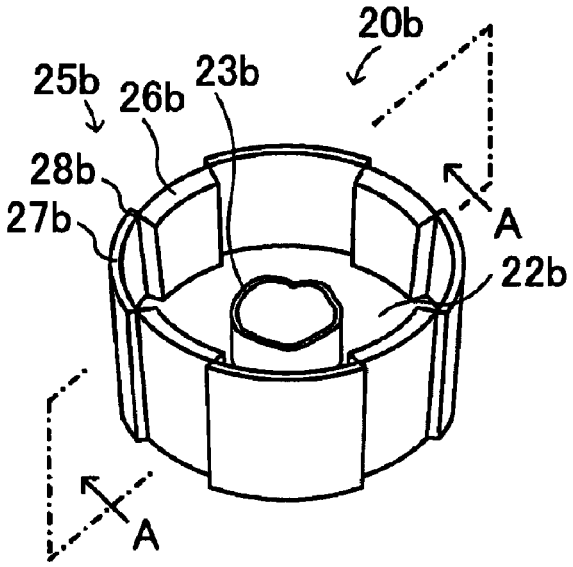
FIG. 5 is a top front perspective drawing showing an outer appearance of a work member 20*b;*
Figure 6:
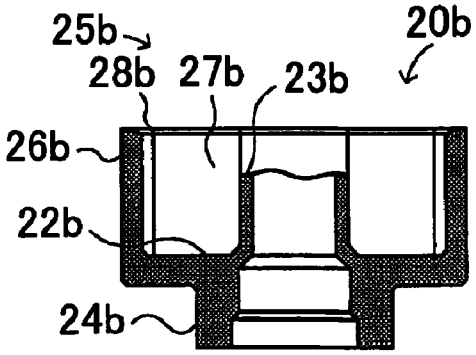
FIG. 6 is a cross-sectional view as seen from a section A-A of the work member 20*b* in FIG. 5.

Next, press work is performed with respect to the ring-like raw material 20*a* to form a work member 20*b*, an example of which is shown in FIGS. 5 and 6 (process S130). FIG. 5 is an top front perspective drawing showing an outer appearance of the work member 20*b*, and FIG. 6 is a cross-sectional view as seen from a section A-A of the work member 20*b* in FIG. 5. The work member 20*b*, as shown in FIGS. 5 and 6, is formed from a ring-like annular part 22*b*, an inner wall part 23*b*, a boss part 24*b*, and an outer wall part 25*b*. The inner wall part 23*b* is formed along an inner periphery of the annular part 22*b* and generally perpendicular to the annular part 22*b*. The boss part 24*b* is on a side of the annular part 22*b* that is opposite the inner wall part 23*b*, and formed along the inner periphery of the annular part 22*b* generally perpendicular to the annular part 22*b*. The outer wall part 25*b* is formed from a leg part 26*b* and a connecting part 27*b*. The leg part 26*b* is formed generally perpendicular to the annular part 22*b* such that an outer peripheral surface of the leg part 26*b* generally coincides with an outer periphery of the annular part 22*b*, which is the same side of the annular part 22*b* formed with the inner wall part 23*b*. The connecting parts 27*b* connect with the leg parts 26*b*. It should be noted that in FIGS. 5 and 6, a boundary portion between the leg part 26*b* and the connecting part 27*b* is shown as a joining region 28*b*.

Figure 7:
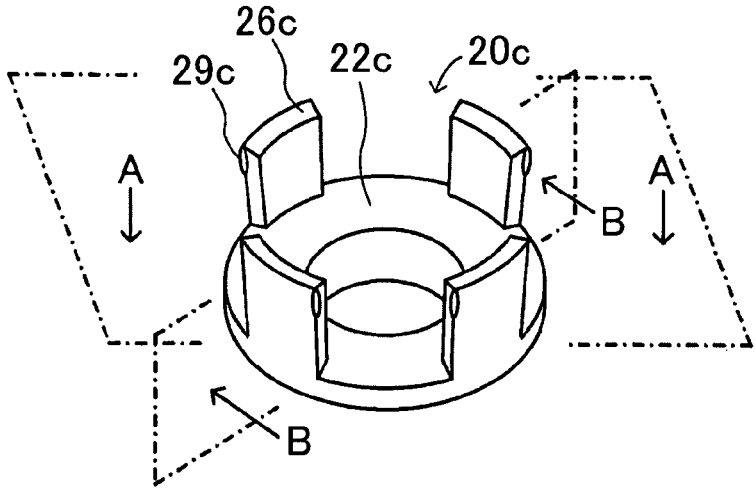
FIG. 7 is a top front perspective drawing showing an outer appearance of an intermediate legged annular member 20*c;*
Figure 8:
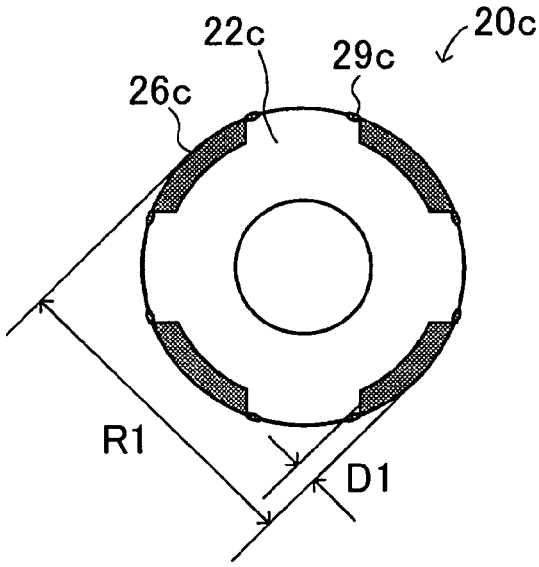
FIG. 8 is a cross-sectional view as seen from a section A-A of the intermediate legged annular member 20*c* in FIG. 7.
Figure 9:
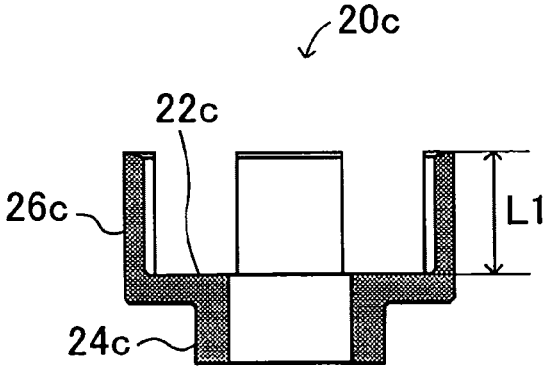
FIG. 9 is a cross-sectional view as seen from a section B-B of the intermediate legged annular member 20*c* in FIG. 7.

Once the work member 20*b* is formed as described above, the connecting part 27*b*, the inner wall part 23*b*, and a portion on an inner peripheral side of the boss part 24*b* is cut away from the formed work member 20*b*. This results in the formation of an intermediate legged annular member 20*c*, an example of which is shown in FIGS. 7 to 9 (process S140). FIG. 7 is a top front perspective view drawing showing an outer appearance of the intermediate legged annular member 20*c*. FIG. 8 is a cross-sectional view as seen from a section A-A of the intermediate legged annular member 20*c* in FIG. 7. FIG. 9 is a cross-sectional view as seen from a section B-B of the intermediate legged annular member 20*c* in FIG. 7. The intermediate legged annular member 20*c*, as shown in FIGS. 7 to 9, is formed from an annular part 22*c*, whose inner diameter is slightly larger than an outer diameter of the inner wall part 23*b* due to cutting away the inner wall part 23*b*; a boss part 24*c*, which is formed along an inner periphery of the annular part 22*c* generally perpendicular to the annular part 22*c*; and a leg part 26*c*, which corresponds to the leg part 26*b* of the work member 20*b*. In the intermediate legged annular member 20*c*, the annular part 22*c* including a base portion of the leg part 26*c* on the annular part 22*c* is formed in the shape of a circle with an outer diameter R1, and the leg part 26*c* from its base on the annular part 22*c* up to its tip end is formed at a thickness D1 with a length L1. In the process to form the intermediate legged annular member 20*c*, cutting away of the connecting part 27*b* may be performed, for example, by applying a force from a side of the connecting part 27*b* based on the annular part 22*b* of the work member 20*b* toward a tip end side thereof, or by applying a force from an inner side of the connecting part 27*b* toward an outer side thereof Once the connecting part 27*b* is cut away from the work member 20*b* to form the intermediate legged annular member 20*c* in this manner, a burr 29*c* may be created on a portion corresponding to the joining region 28*b* of the work member 20*b*. Additionally, the leg part 26*c* may fall slightly inward in the intermediate legged annular member 20*c* after the connecting part 27*b* has been cut away.

Figure 10:
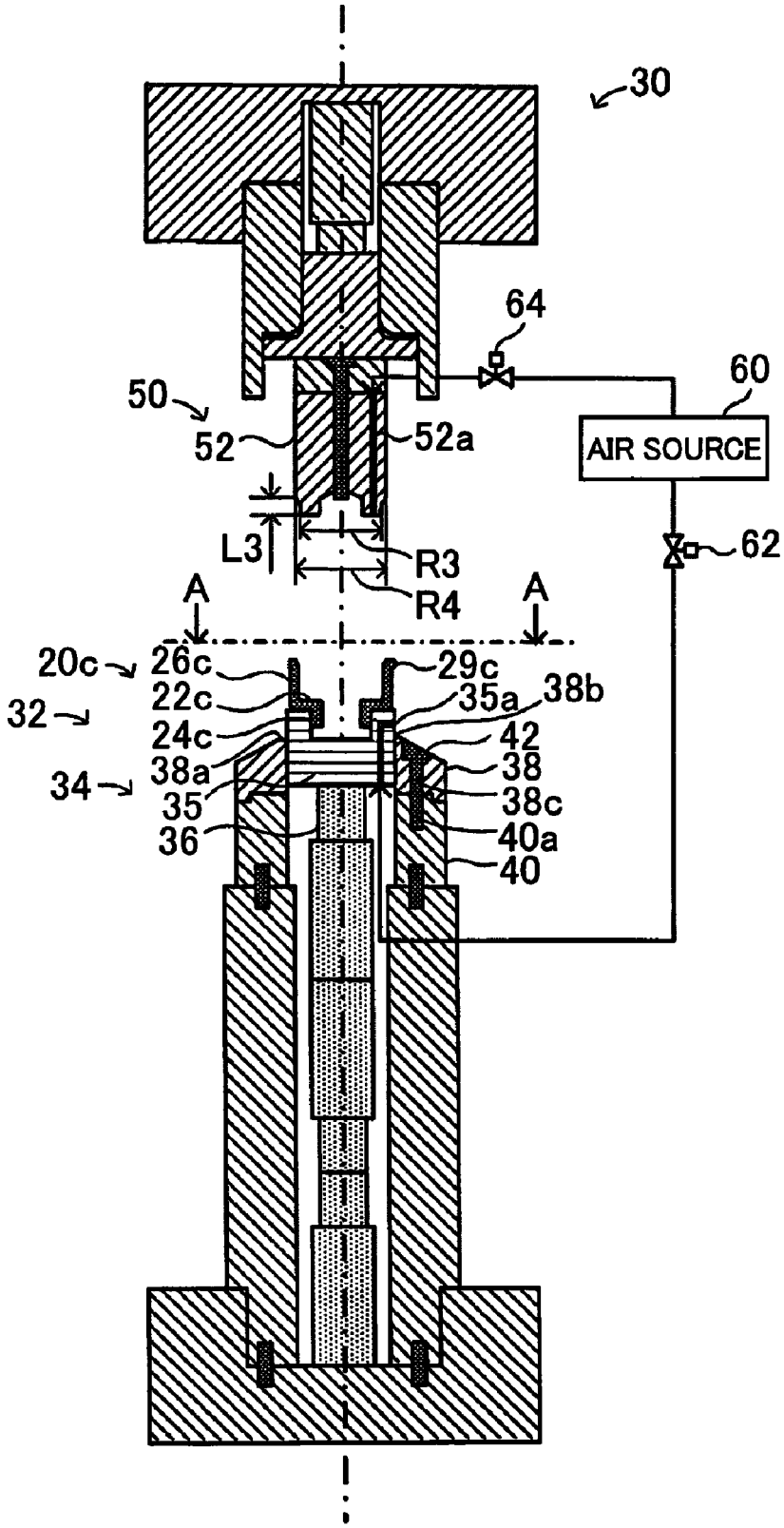
FIG. 10 is a cross-sectional view of the intermediate legged annular member 20*c* and a diameter-expanding burr removal device 30.
Figure 11:
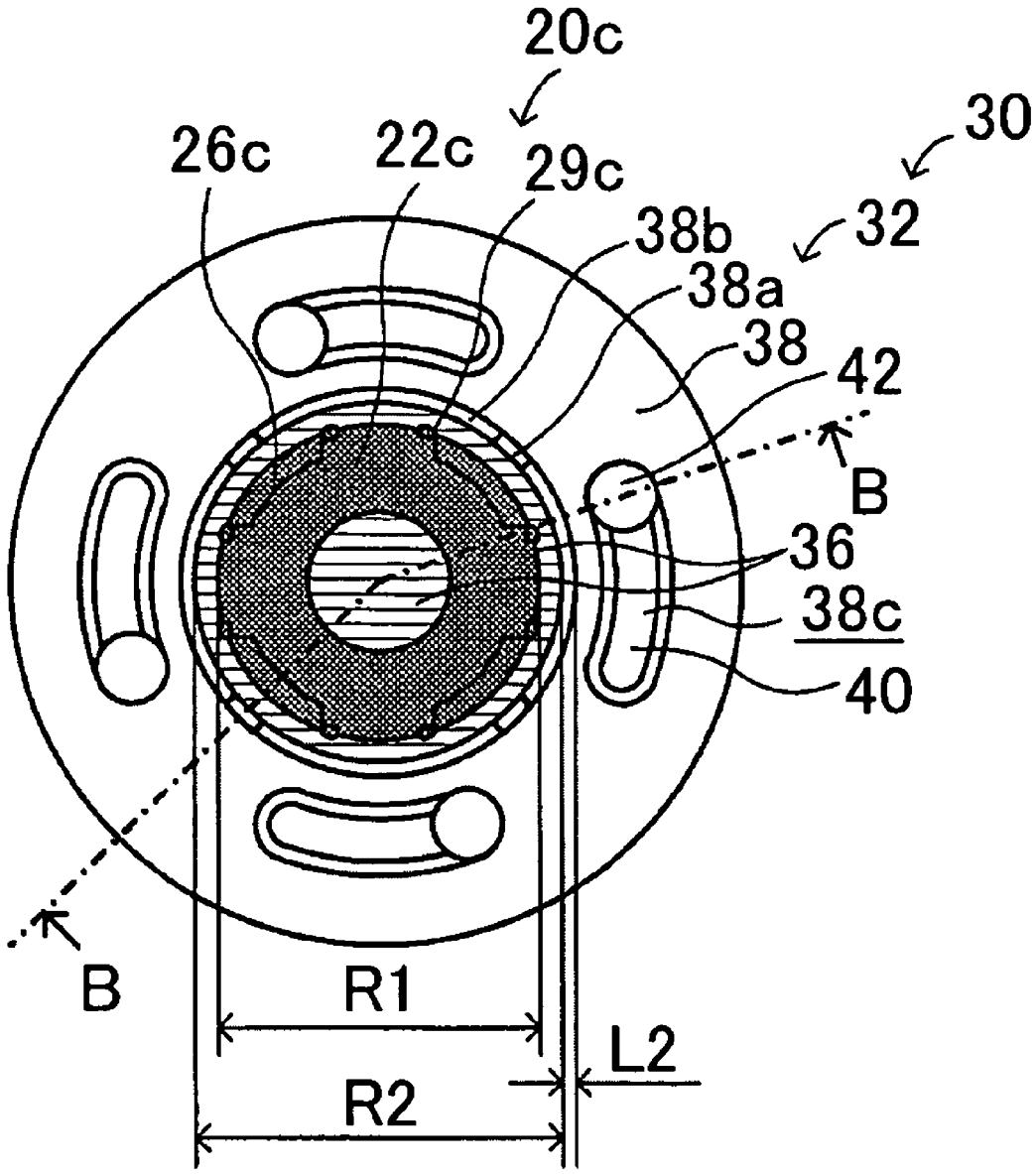
FIG. 11 is a cross-sectional view as seen from a section A-A of the intermediate legged annular member 20*c* and the diameter-expanding burr removal device 30 in FIG. 10.

Next, the burr 29*c* of the leg part 26*c* is removed while expanding the inner diameter of the leg part 26*c* of the intermediate legged annular member 20*c* (process S150). In this embodiment, the process was performed using a diameter-expanding burr removal device 30, an example of which is shown in FIGS. 10 and 11. FIG. 10 is a cross-sectional view of the intermediate legged annular member 20*c* and the diameter-expanding burr removal device 30, and FIG. 11 is a cross-sectional view as seen from a section A-A of the intermediate legged annular member 20*c* and the diameter-expanding burr removal device 30 in FIG. 10. The cross-sectional view of the intermediate legged annular member 20*c* and the diameter-expanding burr removal device 30 in FIG. 10 corresponds to the section B-B in FIG. 11. Also note that in FIG. 11, the intermediate legged annular member 20*c* and a mounting part 35 are shown hatched for easier viewing.

The diameter-expanding burr removal device 30, as shown in FIGS. 10 and 11, is equipped with a lower die 32 that is disposed in a lower portion of the device, and an upper die 50 that is disposed above the lower die 32 generally coaxial therewith. The lower die 32 is mainly equipped with an ejector 34, which is disposed in a generally center upper portion within the lower die 32 and serves as a support mechanism capable of mounting the intermediate legged annular member 20*c*; a die 38, which serves as a hollow member that is disposed on an outer peripheral side of the ejector 34 so as to be generally coaxial with the ejector 34; and a fixed base 40 for fixing the die 38. The ejector 34 is equipped with the mounting part 35 and a gas cushion part 36. An outer peripheral side of an upper end portion of the mounting part 35 is formed in the shape of a circle with an outer diameter R2 that is slightly larger than the outer diameter R1 of the annular part 22*c* of the intermediate legged annular member 20*c*. The mounting part 35 also has an opening portion with an inner diameter that is generally identical to the outer diameter of the boss part 24*c* of the intermediate legged annular member 20*c* and opens deeper than the length of the boss part 24*c*. The gas cushion part 36 is disposed on a lower portion of the mounting part 35 and limits movement toward the lower portion of the mounting part 35. Furthermore, the upper end portion of the mounting part 35 is disposed so as to project in comparison to an upper end portion of the die 38. A plurality of air passages 35*a* are formed that discharges air from slightly above the upper end portion of the die 38 on an outer peripheral surface to outside (toward the upper end portion of the die 38) via an internal portion of the mounting part 35. When an electromagnetic valve 62 that is provided between an air source 60 and the air passage 35*a* is opened, air of a predetermined pressure (e.g. 300 MPa, 400 MPa or the like) is discharged from the air source 60 toward the upper end portion of the die 38 via the air passage 35*a*. In addition, the gas cushion part 36 is formed so as to enable expanding of an inner diameter of the leg part 26*c* of the intermediate legged annular member 20*c* by a diameter-expanding punch 52 (to be described later) in a state where the intermediate legged annular member 20*c* is mounted on the mounting part 35 such that the leg part 26*c* faces up. At the same time, when the intermediate legged annular member 20*c* and the mounting part 35 are moved downward, movement of the mounting part 35 downward can be limited such that a load required for moving the intermediate legged annular member 20*c* and the mounting part 35 downward is larger than a load required for expanding the inner diameter of the leg part 26*c*. The die 38 is formed such that the upper end portion is chamfered or formed generally perpendicular to an inner peripheral surface in the range of a distance L2 from the inner peripheral side to the outer peripheral side, and the upper end portion exceeding the distance L2 becomes lower as the upper end portion approaches the outer peripheral side. Hereinafter, a chamfered portion among the upper end portion of the die 38 will be referred to as a chamfered portion 38*a*, and a portion formed generally perpendicular to the inner peripheral surface will be referred to as a right-angle portion 38*b*. Also, the die 38 is formed with a long hole 38*c* whose shape is longer in a circumferential direction than in a radial direction (e.g. a shape that connects two half circles with an arc or the like) and which runs through in a vertical direction. The fixed base 40 is formed with a round hole 40*a* of a predetermined depth from the upper end portion side. The die 38 can be fixed to the fixed base 40 using a bolt 42 that serves as a fixing member. Therefore, loosening of the bolt 42 enables rotation of the die 38.

The upper die 50 is mainly equipped with the diameter-expanding punch 52 whose lower end portion is disposed facing the upper end portion of the mounting part 35, and the like. A lower end portion of the diameter-expanding punch 52 is formed in the shape of a circle with an outer diameter R3 that is smaller than the inner diameter of the leg part 26*c* of the intermediate legged annular member 20*c*, that is, the inner diameter of the leg part 26*c* when the leg part 26*c* falls slightly inward. A position farther upward than the lower end portion (hereinafter referred to as an intermediate portion), which corresponds to a length L3 shorter than the length L1 of the leg part 26*c*, is formed in the shape of a circle with an outer diameter R4 as seen from the lower end portion side. Furthermore, the diameter-expanding punch 52 expands the inner diameter of the leg part 26*c* of the intermediate legged annular member 20*c* in a state where the intermediate legged annular member 20*c* is mounted on the mounting part 35 such that the leg part 26*c* is on an upper side. At the same time, when the intermediate legged annular member 20*c* and the mounting part 35 are moved downward, the diameter-expanding punch 52 is formed such that the lower end portion of the diameter-expanding punch 52 contacts a surface (an upper surface in FIG. 10) of the annular part 22*c*, and the intermediate portion of the diameter-expanding punch 52 contacts the inner peripheral side of the leg part 26*c*. Here, the outer diameter R4 is a size that ensures an outer diameter of a portion of the burr 29*c* on a tip end of the leg part 26*c* is larger than the inner diameter R2 of the upper end portion of the die 38 when the lower end portion of the diameter-expanding punch 52 contacts the surface of the annular part 22*c* and the intermediate portion contacts the inner peripheral side of the leg part 26*c*, i.e., when the inner diameter of the leg part 26*c* of the intermediate legged annular member 20*c* is expanded). The diameter-expanding punch 52 is formed with an air passage 52*a* that discharges air from the lower end portion to below via an internal portion. When an electromagnetic valve 64 that is provided between the air source 60 and the air passage 52*a* is opened, air of a predetermined pressure is discharged from the air source 60 to below via the air passage 52*a*.

Figure 12:
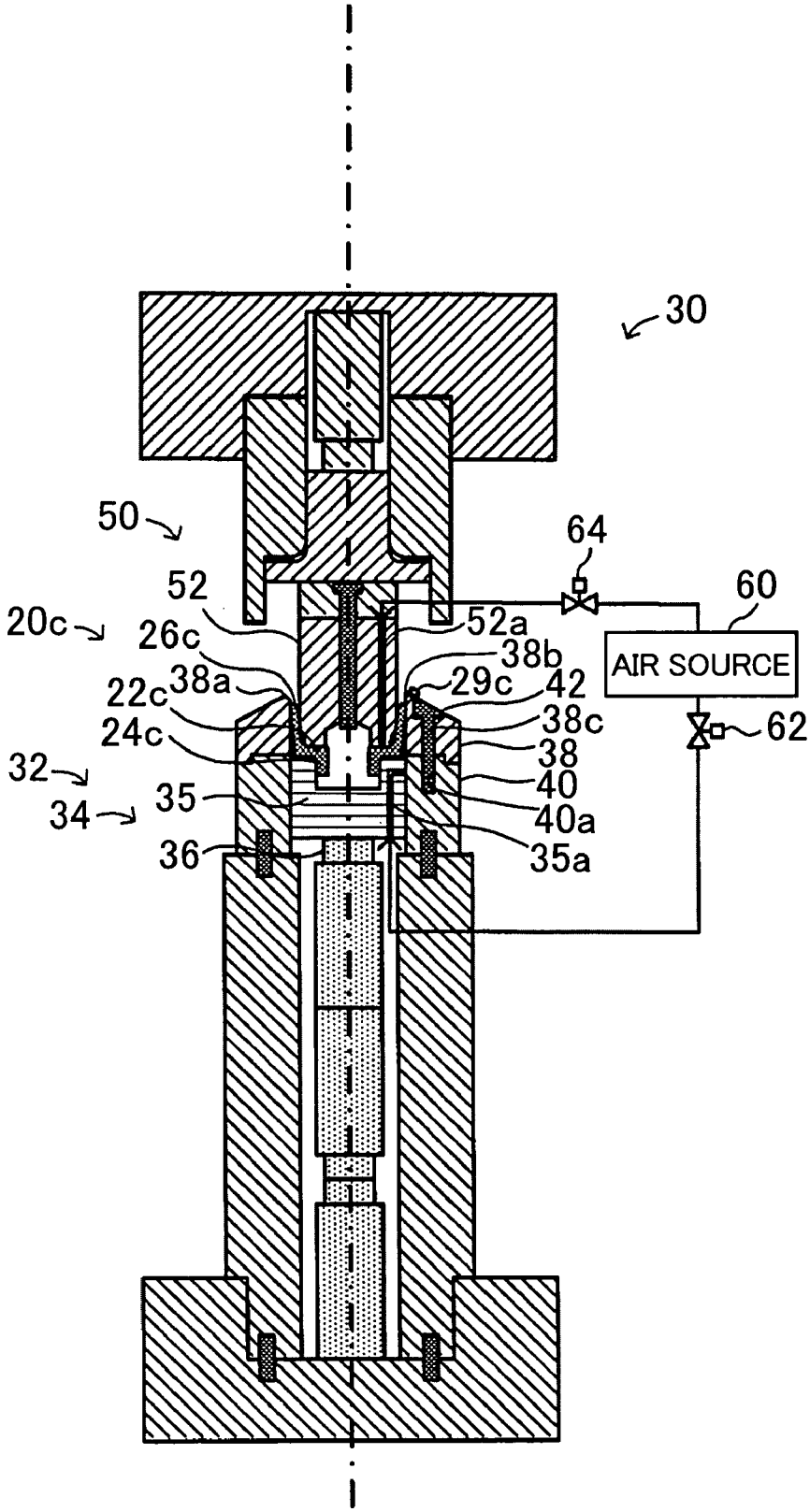
FIG. 12 is an explanatory drawing showing how the diameter-expanding burr removal device 30 is used to expand an inner diameter of a leg part 26*c* of the intermediate legged annular member 20*c* while removing a burr 29*c*.
Figure 13:
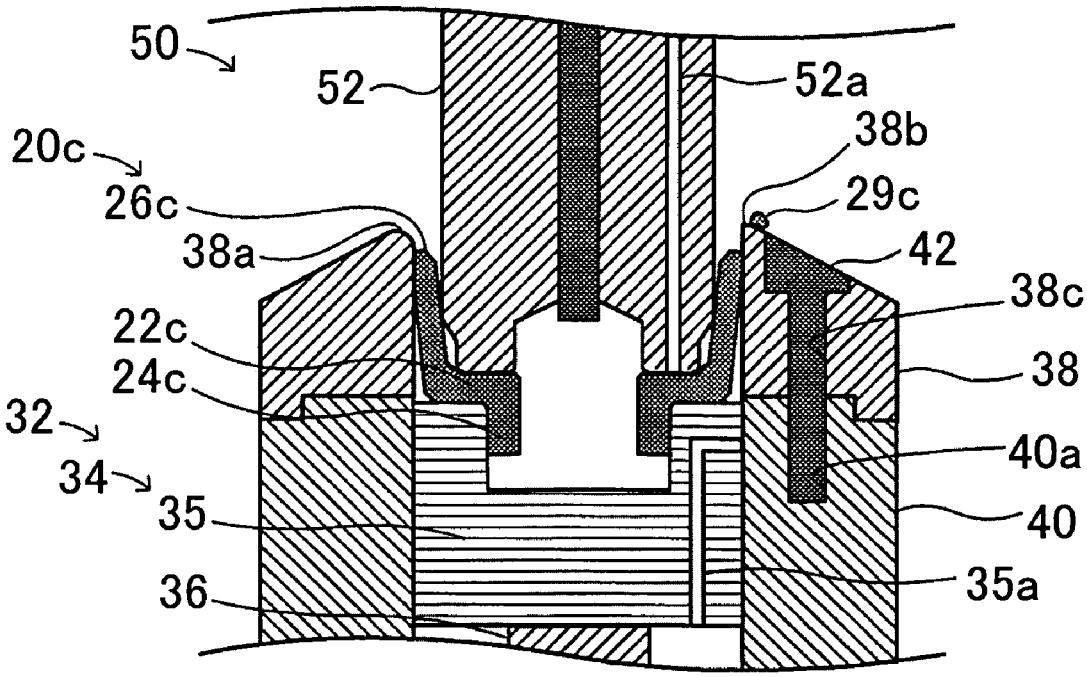
FIG. 13 is a partially enlarged view that enlarges a vicinity of the intermediate legged annular member 20*c* in FIG. 12.

FIG. 12 is an explanatory drawing showing how the diameter-expanding burr removal device 30 is used to expand an inner diameter of the leg part 26*c* of the intermediate legged annular member 20*c* while removing the burr 29*c*. FIG. 13 is a partially enlarged view that enlarges a vicinity of the intermediate legged annular member 20*c* in FIG. 12. To expand the inner diameter of the leg part 26*c* of the intermediate legged annular member 20*c* while removing the burr 29*c*, first, the boss part 24*c* of the intermediate legged annular member 20*c* is fit into the opening portion at generally the center of the mounting part 35, and the intermediate legged annular member 20*c* is mounted such that the general center in the circumferential direction of the leg part 26*b* of the intermediate legged annular member 20*c* is positioned on an inner side along a radial direction of the chamfered portion 38*a* of the die 38 (see FIGS. 10 and 11). Then, once the upper die 50 is lowered in such a state, a portion of the diameter-expanding punch 52 first contacts the intermediate legged annular member 20*c*. When the upper die 50 is lowered further, as described earlier, the inner diameter of the leg part 26*c* expands because the load required for moving the intermediate legged annular member 20*c* and the mounting part 35 downward is larger than the load required for expanding the inner diameter of the leg part 26*c* of the intermediate legged annular member 20*c*. Once the lower end portion of the diameter-expanding punch 52 contacts the surface of the annular part 22*c* and the intermediate portion of the diameter-expanding punch 52 contacts the inner peripheral side of the leg part 26*c*, the inner diameter of the leg part 26*c* does not expand further while the intermediate legged annular member 20*c* and the mounting part 35 move downward. The burr 29*c* on the tip end of the leg part 26*c* then contacts an end portion on the inner peripheral side of the die 38. At such time, a force corresponding to a force from the diameter-expanding punch 52 pressing down the intermediate legged annular member 20*c* and the mounting part 35 acts from the die 38 in a direction from the base side of the leg part 26*c* to a tip end thereof on a portion of the burr 29*c* at the general tip end of the leg part 26*c*, thereby removing the burr 29*c* of the leg part 26*c*. In other words, processing to expand the inner diameter of the leg part 26*c* and processing to remove the burr 29*c* of the leg part 26*c* are performed in series. It should be noted that at such time, a tip end of a center portion in the circumferential direction of the leg part 26*c* contacts the chamfered portion 38*a* of the die 38, whereby scraping can be suppressed. Subsequent raising of the upper die 50 results in raising of the now burr-less intermediate legged annular member 20*c* and the mounting part 35, due to a force that raises the mounting part 35 from the gas cushion part 36. As a consequence, the diameter-expanding burr removal device 30 returns to the state in FIG. 10. Once the upper die 50 separates from the intermediate legged annular member 20*c* as described above, the leg part 26*c* whose inner diameter has been expanded due to elastic deformation becomes generally perpendicular to the annular member 20*c* and generally the same shape as the completed carrier 20 (see FIGS. 1 and 2). In this manner, it is possible to remove a burr generated by cutting away the connecting part 27*b* of the work member 20*b*, and also possible to expand the inner diameter of the leg part 26*c* if the leg part 26*c* falls slightly inward after the connecting part 27*b* is cut away. Furthermore, with this diameter-expanding burr removal device 30, opening the electromagnetic valve 64 in a state where the intermediate legged member 20*c* is mounted on the mounting part 35 in order to discharge air from the diameter-expanding punch 52 to below enables the removal of dirt and the like on an upper surface of the annular part 22*b*. Moreover, opening the electromagnetic valve 62 in a state where the upper end portion of the mounting part 35 projects farther than the upper end portion of the die 38 (such as when the state shown in FIG. 9 is returned to after removing the burr 29*c* on the leg part 26*c*, for example) in order to discharge air from the outer peripheral surface of the mounting part 35 to the upper end portion of the die 38 ensures that the burr 29*c* is not deposited on the upper end portion of the die 38. Also, with this diameter-expanding burr removal device 30, rotating the die 38 enables switching of the position of the right-angle portion 38*b* of the die 38, which contacts the burr 29*c* upon removal of the burr 29*c* from the leg part 26*c*. Therefore, the life of the die 38 can be lengthened.

Finally, a finishing process is performed (process S160), which completes the carrier 20 serving as the legged annular member described above. Here, the finishing process may be a process that removes the metallic soap coating the surface of the intermediate legged annular member 20*c* if phosphate coating was performed in process S120, or coining that smoothes the surface of the annular part 22*c* of the intermediate legged annular member 20*c*, for example.

According to the above-described method for manufacturing the carrier 20 of the embodiment, the inner diameter of the leg part 26*c* of the intermediate legged annular member 20*c*, which includes the annular part 22*c* and the leg part 26*c*, is expanded while the burr 29*c* is removed in order to complete the carrier 20. Therefore, the number of manufacturing processes until completion of the carrier 20 can be reduced, compared to performing separate processes to expand the diameter of the leg part 26*c* and remove the burr 29*c*. Thus, it is possible to shorten the period of time needed for completion of the carrier 20.

In addition, according to the diameter-expanding burr removal device 30 used in manufacturing of the carrier 20 of the embodiment, the inner diameter of the leg part 26*c* of the intermediate legged annular member 20*c* is expanded while the burr 29*c* is removed. Therefore, the number of manufacturing processes until completion of the carrier 20 can be reduced, compared to performing separate processes to expand the diameter of the leg part 26*c* and remove the burr 29*c*. Thus, it is possible to shorten the period of time needed for completion of the carrier 20. Furthermore, according to the diameter-expanding burr removal device 30 of the embodiment, air can be discharged from the outer periphery of the mounting part 35 to the upper end portion of the die 38 in a state where the upper end portion of the mounting part 35 of the ejector 34 projects farther than the upper end portion of the die 38. This ensures that the burr 29*c* removed from the leg part 26*c* is not deposited on the upper end portion of the die 38. Also, air can be discharged from the diameter-expanding punch 52 to below in a state where the intermediate legged annular member 20*c* is mounted on the mounting part 35, which enables the removal of dirt and the like from the annular part 22*c*. Moreover, shaping the long hole 38*c* for fixing the die 38 to the fixed base 40 longer in the circumferential direction rather than the radial direction allows rotation of the die 38. As a consequence, a portion contacting the burr 29*c* for removal of the burr 29*c* from the leg part 26*c* can be switched, which lengthens the life of the die 38.

According to the diameter-expanding burr removal device 30 of the embodiment, the air passage 52*a* is formed in an internal portion of the diameter-expanding punch 52 in the upper die 50 in order to discharge air from the lower end portion thereof to below. However, such an air passage 52*a* need not be formed. Also, according to the diameter-expanding burr removal device 30 of the embodiment, the air passage 35*a* is formed in an internal portion of the mounting part 35 of the ejector 34 in the lower die 32 in order to discharge air from the outer peripheral surface thereof to the upper end portion of the die 38. However, such an air passage 35*a* need not be formed. In the case of the latter, the mounting part 35 may be disposed such that the upper end portion of the mounting part 35 is slightly lower than the inner peripheral side of the upper end portion of the die 38 (in a range where, when the intermediate legged annular member 20*c* is mounted on the mounting part 35, the burr 29*c* on the tip end of the leg part 26*c* is higher than the inner peripheral side of the tip end portion of the die 38).

According to the diameter-expanding burr removal device 30 of the embodiment, the inner peripheral side of the upper end portion of the die 38 has the chamfered portion 38*a*. However, providing only the right-angle portion 38*b* without providing such a chamfered portion 38*a* is also possible. With regard to the inner peripheral side of the upper end portion of the die 38, rather than the right-angle portion 38*b* formed generally perpendicular to the inner peripheral surface, an acute-angle portion formed at an acute angle with respect to the inner peripheral surface may be provided.

According to the diameter-expanding burr removal device 30 of the embodiment, the die 38 is formed with the long hole 38*c*, which is shaped longer in the circumferential direction than the radial direction. However, a hole shaped generally circular or the like may be formed instead of the long hole 38*c*. Namely, a hole that does not allow rotation of the die 38 in the circumferential direction is also possible.

In the embodiment, a method for manufacturing the carrier 20 of a planetary gear mechanism and the diameter-expanding burr removal device 30 for use in manufacturing the carrier 20 were described. However, the manufacturing method and manufacturing equipment of the present invention are not limited to only manufacturing such a carrier 20, provided that: 1) the method is for manufacturing a legged annular member with a rig-like annular part, 2) at least one leg is formed on an outer peripheral side of the annular part generally perpendicular to the annular part; and 3) the manufacturing equipment is used to manufacture this legged annular member.

A best mode for carrying out an embodiment of the present invention was described above. However, the present invention is not particularly limited to such an embodiment, and a range of various modes are naturally possible that fall within the scope of the present invention.

The present invention can be utilized in the industry of manufacturing a legged annular member such as a carrier of a planetary gear mechanism.

What is claimed is:

1. A method for manufacturing a legged annular member, the legged annular member comprising a ring-like annular part and at least one leg formed on an outer peripheral side of the annular part and generally perpendicular to the annular part, the method comprising:

(a) forming a work member from a raw material with a predetermined shape, with the work member comprising the annular part and a skirt-like outer wall part that has a leg part forming the leg and a connecting part connected with the leg part, wherein the leg part and connecting part are joined at a joining region;

(b) forming an intermediate legged annular member by removing the connecting part from the formed work member; and (c) forming the legged annular member by performing a process to expand an inner diameter of the leg part while performing a process to remove a burr on the joining region.

2. The method for manufacturing a legged annular member according to claim 1, wherein the step (c) is a process where burr removal on the joining region is performed by a force applied on the leg part in a direction from a base side of the leg part to a tip end of the leg part.

3. The method for manufacturing a legged annular member according to claim 1, wherein the step (c) is a process where the burr removal on the joining region at generally a tip end of the leg part is performed while an outer diameter of the tip end of the leg part is expanded to be wider than an outer diameter of a base on the annular part.

4. Manufacturing equipment for manufacturing a legged annular member, the manufacturing equipment comprising:

a support mechanism including an upper end portion thereof which is designed to support an intermediate legged annular member, wherein the intermediate legged annular member comprises an annular part and a leg part that forms a leg, with a burr on at least one portion of the leg;

a hollow member that is disposed on an outer peripheral side of the support mechanism generally coaxial with the support mechanism, and formed such that an upper end portion on an inner peripheral side of the hollow member is circular-shaped with a diameter larger than an outer diameter of the annular part; and a diameter-expanding punch that is disposed facing the upper end portion of the support mechanism, wherein a lower end portion of the diameter-expanding punch is formed in the shape of a circle with an outer diameter that is smaller than an inner diameter of the leg part of the intermediate legged annular member, and wherein an intermediate portion of the diameter-expanding punch farther upward than the lower end portion of the diameter-expanding punch is formed in the shape of a circle with an outer diameter of a size that ensures an outer diameter of a portion of the burr on a top end of the leg part is larger than an inner diameter of an upper end portion of the hollow member.

5. The manufacturing equipment for manufacturing a legged annular member according to claim 4, wherein the upper end portion of the support mechanism projects farther than the upper end portion of the hollow member, and wherein the upper end portion of the support mechanism has a first air discharging portion discharging air to an outside peripheral surface in the direction of the upper end portion of the hollow member.

6. The manufacturing equipment for manufacturing a legged annular member according to claim 4, wherein the diameter-expanding punch has an air discharging portion discharging air from the lower end portion thereof toward the upper end portion of the support mechanism.

7. The manufacturing equipment for manufacturing a legged annular member according to claim 4, wherein the hollow member is formed such that at least a portion of the upper end portion on the inner peripheral side is generally at one of a right angle or an acute angle with respect to an outer peripheral side thereof.

8. The manufacturing equipment for manufacturing a legged annular member according to claim 4, wherein the hollow member is formed such that a portion of the upper end portion on the inner peripheral side has a chamfered shape.

9. The manufacturing equipment for manufacturing a legged annular member according to claim 4, further comprising:

a fixed base with a hole for affixing the hollow member thereto, wherein the hollow member has a long hole that is formed in a direction generally vertical from a surface contacting a support base with a shape longer in a circumferential direction than a radial direction, and wherein the hollow member is fixed to the fixed base by a fixing member that fits within the long hole and a hole in the fixed base.

* * * * *